US005901758A

United States Patent [19]

Hwang et al.

[11] Patent Number: 5,901,758

[45] Date of Patent: May 11, 1999

[54] METHOD OF FILLING GAS CONTAINERS

[75] Inventors: Shuen-Cheng Hwang, Chester; André Micke, Summit, both of N.J.; Ramachandran Krishnamurthy, Chestnut Ridge, N.Y.

[73] Assignee: The BOC Group, Inc., Murray Hill, N.J.

[21] Appl. No.: 08/846,990

[22] Filed: Apr. 30, 1997

[51] Int. Cl.[6] ..... B65B 1/04

[52] U.S. Cl. ..... 141/2; 141/18; 141/40; 141/39; 141/197

[58] Field of Search ..... 141/2, 4, 9, 18, 141/39, 40, 47, 48, 49, 54, 99, 128, 197

[56] References Cited

U.S. PATENT DOCUMENTS

| | | | |
|---|---|---|---|
| 4,153,083 | 5/1979 | Imler et al. | 141/39 |
| 4,582,100 | 4/1986 | Poulsen | 141/4 |
| 5,409,046 | 4/1995 | Swenson et al. | 141/4 |
| 5,515,888 | 5/1996 | Graffin | 141/128 |

*Primary Examiner*—Steven O. Douglas

*Attorney, Agent, or Firm*—Coleman R. Reap; Salvatore P. Pace

[57] ABSTRACT

Filling a gas vessel by initially flowing gas into the vessel at a rate low enough to avoid sudden heating of the gas, then increasing the fill rate until the maximum fill rate is attained, then reducing the flow rate as the vessel approaches the filled condition.

15 Claims, 1 Drawing Sheet

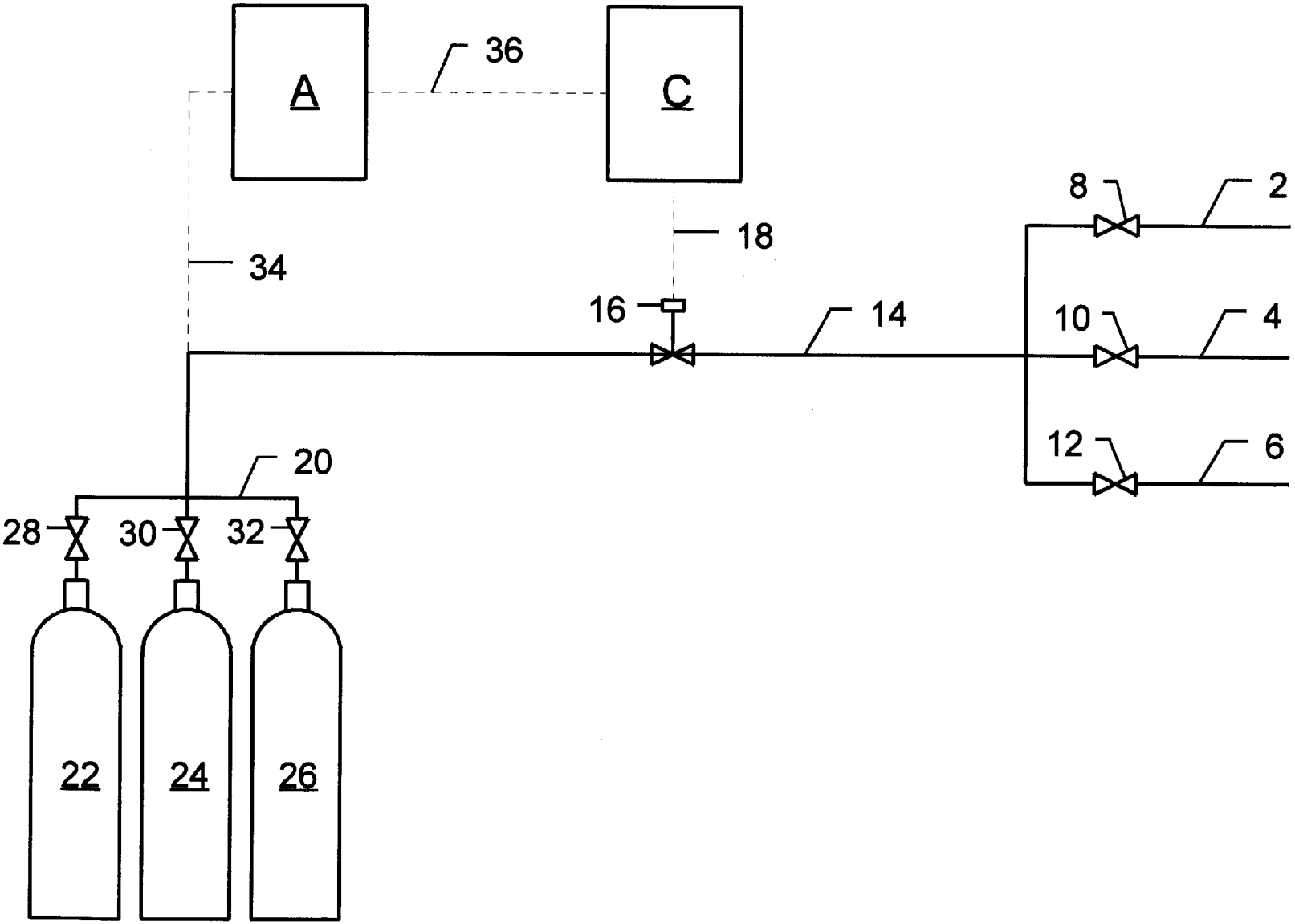
2
4
6
8
10
12
14
18
C
16
36
A
34
20
32
26
30
24
28
22

METHOD OF FILLING GAS CONTAINERS

FIELD OF THE INVENTION

This invention relates to the filling of gas storage vessels with gases, and more particularly to a method of more accurately filling gas cylinders with desired quantities of a gas or a mixture of gases when filling the vessels by pressure difference.

BACKGROUND OF THE INVENTION

Gas storage vessels, such as gas cylinders or bottles, are commonly filled with gases by charging the gas into the vessel until the desired pressure is reached. It is desirable to fill the vessels as quickly as possible, but it is also important to accurately fill the vessels with the target quantity of gas. One problem that makes it difficult to accurately measure the amount of gas in a gas vessel is the temperature-pressure relationship of contained gases. By virtue of the gas laws, the pressure exerted by a given quantity of gas at constant volume is directly proportional to its temperature. Accordingly, as the temperature of a gas increases, so will the pressure of the gas. Thus, in filling gas storage vessels by pressure measurements it is important that the gas in the vessel when it approaches its "filled" condition be at a preselected temperature to ensure that the correct amount of gas is charged into each vessel being filled.

Since it is desirable to fill the gas vessel in the shortest time period, it is customary to immediately open the fill valve to the wide-open position. This causes an immediate blast of gas to enter the empty vessel, which causes the temperature of the gas being charged into the vessel to rise rapidly as it impinges the walls of the vessel. Rapid filling of the vessel does not continue to cause a rapid temperature increase throughout the filling process, and the initially heated gas cools as additional gas is charged into the vessel. But often the gas temperature does not return to the preselected temperature during the filling process, so that it is difficult or impossible to charge the correct amount of gas into the vessel without the time-consuming step of cooling the gas to the preselected temperature.

The problem is exacerbated when filling the gas vessel with mixtures of gases. In this case, a first gas is charged into the vessel until the vessel contains the desired amount of this gas, and then a second gas is charged into the vessel until the desired amount of that gas is charged into the vessel. This procedure is repeated until all of the gases are charged into the vessel. Since it is generally necessary that the composition of the gas mixture meet narrow specifications. It is important that the temperature of the gas mixture be within narrow limits as the fill endpoint for each component is approached. Thus, if excessive heating occurs during the early stages of the filling process, the gas must be cooled before making the final measurement of the first component, and perhaps cooling may have to be done before final measurement of each component of the gas mixture.

Another phenomenon which makes it difficult to accurately fill gas vessels with specific quantities of gases is that the pressure drop in a gas pipeline through which a gas is flowing is directly proportional to the velocity of the gas flowing through the pipeline: the pressure drop over a given length of pipeline increases as the rate of flow of gas through the pipeline increases. Thus, if a gas vessel is being filled with gas from a gas line which has a pressure gauge upstream of the gas vessel, the pressure at the pressure gauge will be higher than the actual pressure in the vessel, so that if gas is flowing through the fill line at a rapid rate and the pressure gauge is used to determine the cutoff point of the fill process, the gas vessel will not be filled with the correct quantity of gas.

Since time is valuable and accuracy of filling is important, it would be desirable to fill empty gas vessels with single gases or gas mixtures by a method which does not cause a rapid rise of the temperature of the gas when gas is introduced into an empty vessel, and to eliminate or minimize the error caused by differences in pressure at a pressure gauge in the fill line and the actual pressure in the vessel. The present invention provides a method which meets these objectives.

SUMMARY OF THE INVENTION

The invention is a method of filling a gas vessel with a gas or a mixture of gases by a method which eliminates or minimizes sudden increases of temperature in the vessel being filled, particularly during the earlier part of the filling procedure. A broad embodiment of the invention comprises as steps:

(a) initiating flow of gas into an empty gas vessel at an initial rate;

(b) increasing the rate of flow of the gas into the gas vessel until a predetermined maximum flow rate is attained;

(c) reducing the flow rate of the gas into the gas vessel as the difference between the measured quantity and desired final quantity of the gas in the gas vessel diminishes; and (d) terminating flow of the gas into the gas vessel when the gas vessel contains the desired final quantity of the gas.

In a preferred embodiment, the time required for the rate of flow of the gas into the gas vessel to reach the predetermined maximum flow rate is in the range of about 25 to about 75% of the total filling time for the gas.

In another preferred embodiment, step (c) is begun when the gas vessel contains about 75 to about 95% of the desired final quantity of the gas.

In the broad embodiment or either preferred embodiment, the initial flow rate set in step (a) is preferably sufficiently low to avoid any sudden increase in the temperature of gas in the gas vessel. Likewise, in either the broad or in either preferred embodiment the rate of increase of flow of the gas into the vessel during step (b) is preferably sufficiently low to avoid any sudden increase in the temperature of gas in the gas vessel.

In any of the above embodiments the rate of increase of flow of the gas into the gas vessel during step (b) can be constant or it can be increased as the difference between the predetermined maximum flow rate and the measured flow rate decreases. Similarly, in any of the above embodiments the rate of decrease of flow of the gas into the gas vessel during step (c) can be constant or it can be decreased as the difference between the actual quantity of said gas in said gas vessel and the desired final quantity of said gas in said gas vessel decreases.

In the preferred aspect of the invention, the actual quantity of the gas in the gas vessel and the desired final quantity of that gas in the vessel are determined by the partial pressure of the gas contained in the gas vessel.

The invention can be used to fill a gas vessel with a mixture of two or more different gases. One or more of the gases of the mixture can be charged into the gas vessel using the method of any one of the above embodiments. The invention can also be used to fill the gas vessel with such a mixture by a technique wherein the components of the gas mixture are serially charged into the gas vessel and wherein each of the components is charged into the vessel by the method of any of the broad embodiments described above, repeating steps (a) to (d) for each of the two or more gases.

In a more preferred embodiment of the invention, step (c) is begun when the gas vessel contains about 85 to about 95% of the desired final quantity of the gas being charged into the vessel.

The process of the invention is particularly suitable for filling gas cylinders by pressure measurements.

In another preferred embodiment the rate of flow of gas during the various steps of the filling method is determined by a preselected program.

BRIEF DESCRIPTION OF THE DRAWING

The drawing illustrates a system that is useful for filling gas cylinders by the method of the invention. Auxiliary equipment, including compressors, heat exchangers and valves, not necessary for an understanding of the invention, have been omitted from the drawings to simplify discussion of the invention.

DETAILED DESCRIPTION OF THE INVENTION

One feature of the invention takes advantage of the fact that gases rapidly heat up when they are initially charged into an empty vessel at a rapid rate due to impingement of the gas against the walls of the empty vessel and the inability of the heat to dissipate, but the gas does not undergo rapid temperature rise if the vessel already contains sufficient gas to cushion the force of the gas entering the vessel.

Another feature of the invention takes advantage of the fact that the pressure drop in a gas line is inversely proportional to the rate of flow of gas through the gas line. Thus, a gas vessel can be quickly filled through a gas fill line having a gas pressure gauge with a precise quantity of gas by first slowly introducing the gas into the vessel until there is enough gas contained in the vessel to prevent rapid temperature rise of the gas in the vessel, and then gradually increasing the rate of introduction of gas into the vessel until the fill valve is wide open, and as the quantity of gas in the vessel approaches the desired value gradually reducing the rate of introduction of gas into the vessel to reduce the difference in pressure in the fill line at the pressure gauge and that in the vessel itself, and thereby eliminate or minimize error caused by such differences at the time of termination of the filling step.

The invention can be better understood from the accompanying drawing, which illustrates a system for filling gas cylinders by pressure measurements. The system includes a battery of gas cylinders that are to be filled, lines for transferring gas from a source to the gas cylinders, a pressure sensing device A and a control unit C for controlling the gas filling rate. The system can be used to fill gas cylinders with single gases or gas mixtures which are supplied to the system from storage sources (not shown) through lines 2, 4 and 6. Valves 8, 10 and 12, control flow of gases through lines 2, 4 and 6, respectively. Gas from lines 2, 4 and/or 6 flows into line 14, which is provided with flow controller 16, which can be any means, such as a variable orifice, for controlling the flow through line 14. Flow controller 16 is activated in response to a signal received from control unit C, through control loop 18. Control unit C is typically a computer which analyzes the signal received from pressure sensing device A and sends a signal to flow controller 16 to make adjustments in the flow of gas through line 14, as necessary. Downstream of flow controller 16 line 4 is connected to cylinder fill manifold 20 which, in turn, is connected to gas cylinders 22, 24 and 26 through valves 28, 30 and 32, respectively. Pressure sensing means A measures the pressure in line 14 via a line tap which is connected to pressure sensing line 34. Pressure sensing means A sends a signal to control unit A via control loop 36.

Practice of the invention will now be described to fill gas cylinder 22 in the system illustrated in the drawing with a single selected gas from a source that is connected to the system through line 2. Valves 8 and 28 are opened and flow controller 16 is set to provide an initial gas flow rate that is below the threshold flow rate at which a significant temperature spike would occur in the gas cylinder due to impingement of the incoming gas on the walls of empty cylinder 22. When sufficient gas has been introduced into the gas cylinder to provide a cushion that prevents rapid temperature rise of the gas in cylinder 22, the flow rate is gradually increased during the first phase of the filling procedure, the rate of increase being such as to avoid significant heating of the gas in the cylinder being filled. It is desired, of course, to attain the maximum flow of gas through line 14 as quickly as possible, consistent with the objective of not causing undue heating of the gas in the cylinder. The flow rate may be increased at a constant rate or at a variable rate. In general, the rate of gas flow can be increased more rapidly as the filling process progresses. In other words, the sensitivity of the gas filling rate increasingly diminishes as the differential between the pressure of the gas in the cylinder and that in line 14 decreases. Accordingly, it is usually preferable to increase gas flow through line 14 more rapidly as the filling procedure progresses. The maximum gas flow rate is desirable reached when the gas cylinder is filled with about 5 to about 25%, and preferably about 5 to about 15%, of the total quantity of gas to be charged into the cylinder, measured as pressure by pressure sensor A.

The second phase of the filling process comprises charging gas into the cylinder at the maximum rate. This phase is continued until the cylinder is filled with about 75 to about 95, and preferably about 85 to about 95%, of the total quantity of gas being charged into the cylinder, again measured as pressure by pressure sensor A. The filling procedure then enters the third phase of the filling procedure.

During the third phase of the process, the rate of flow of gas into the cylinder being filled is gradually reduced to reduce the difference in pressure at the point where control loop 34 enters line 14 and inside gas cylinder 22. As the difference in the pressure measured by sensor A and the target pressure decreases, the rate of filling continues to be decreased, so that the flow rate just prior to the time when the desired end point is reached will be low enough that the difference between the pressure at the point at which line 34 enters line 14 and the pressure inside cylinder 22 will be insignificant, and the pressure sensed by sensor A will accurately reflect the pressure inside cylinder 22. When the sensed pressure reaches the desired end point controller C causes flow controller 16 to close, thereby stopping flow of gas into cylinder 22. When each of cylinders 22, 24 and 26 is filled by the above procedure, each cylinder will be filed with substantially the same amount of gas.

When the process is used to fill gas cylinders with gas mixtures, the above procedure is repeated for each gas component of the mixture, by opening valves 8, 10 and 12 in any desired order. It is usually preferred to charge the lightest gas into the cylinder first to provide more rapid mixing of the gases in the cylinder. If, in preparing gas mixtures, the quantity of the first component to be charged into the cylinder is sufficiently high to prevent subsequent temperature rise in the gas cylinder as the other component or components are charged into the cylinder, the rate of opening of flow controller 16 is not critical and the flow controller can be rapidly opened without significant temperature rise. If, however, the quantity of first component being introduced into the cylinder is small, it may be necessary to slowly introduce the first component and slowly initiate flow of the second component (and perhaps subsequent components) until sufficient total gas is introduced into the cylinder to provide a gas cushion sufficient to prevent rapid temperature during the remainder of the filling process.

The above procedure describes the method of the invention as it is practiced using feed back techniques. As earlier indicated, the method can also be practiced using feed forward procedures. In the latter case, the gas flow rates during the various steps of the method can be controlled, for example, by means of a predetermined program.

It will be appreciated that it is within the scope of the present invention to utilize conventional equipment to monitor and automatically regulate the flow of gases within the system so that it can be fully automated to run continuously in an efficient manner.

The invention is further illustrated by the following example in which, unless otherwise indicated, parts, percentages and ratios are on a volume basis.

EXAMPLE 1

The system illustrated in the appended drawing was modified to simultaneously fill 14 gas cylinders, each having a water volume of about 50 liters, to a final pressure of 182.02 bara at a reference temperature of 21.1° C. with a gas mixture comprising 98 mole % argon and 2 mole percent oxygen. The oxygen supply was connected to line 2 and the argon supply to line 4. Both gas components were supplied with a pressure of 206 bara. Prior to filling, the cylinders were vented and evacuated to an initial pressure of about 0.4 bara. During this period, orifice-controlled valve 16 and the cylinder valves were kept open to evacuate the lines upstream of valve 16.

A target oxygen partial pressure of 3.85 bara at a cylinder temperature of 21.1° C. is necessary to produce the desired gas mixture.

The filling process was initiated by closing valve 16 and opening valve 8. All cylinder valves remained open. Flow control valve 16 was then opened to about 1% of its maximum opening. This created an initial pressure jump of about 0.48 bar in line 20. Controller C regulates the orifice size in valve 16 so that the rate of pressure increase was approximately 0.69 bar/min. When the partial pressure in the cylinder reached 3.85 bara, valve 8 was closed. The orifice in valve 16 was again set to 1% of maximum, and argon supply valve 10 was opened. The orifice was controlled to permit a pressure increase rate of approximately 10 bar/min. At 5.5 bar below the final pressure (182.02 bara @ 21.1° C.) the flow rate was reduced to 1.7 bar/min, and at 1.4 bar below the final pressure the flow rate was decreased to 0.69 bar/min. When the total pressure of 182.02 bara @ 21.1° C. was reached, supply valve 10 and all cylinder valves were closed. The gas mixture in the cylinders was analyzed and found to contain an average of 1.86% oxygen.

In contrast to the above, when the orifice in line 14 was fully opened at the beginning of the oxygen introduction into the cylinders, the pressure jump was more than 13.8 bar during the first second that valve 8 was opened, i.e. the pressure exceeds the target value of 3.85 bara at 21.1° C.

Although the invention has been described with particular reference to specific equipment arrangements and to a specific example, these features are merely exemplary of the invention and variations are contemplated. For example, vessels other than gas cylinders can be filled by the process of the invention and other equipment arrangements can be used in the invention. Similarly, the gas vessels can be filled with mixtures containing more than three components. The scope of the invention is limited only by the breadth of the appended claims.

What is claimed is:

1. A method of filling a gas vessel with a gas comprising the steps:

(a) initiating flow of said gas into said gas vessel at an initial rate;

(b) increasing the rate of flow of said gas into said gas vessel until a predetermined maximum flow rate is attained;

(c) reducing the flow rate of said gas into said gas vessel as the difference between the measured quantity and desired final quantity of said gas in said gas vessel diminishes; and (d) terminating flow of said gas into said gas vessel when said gas vessel contains the desired final quantity of said gas.

2. The method of claim 1, wherein the time required for the rate of flow of said gas into said gas vessel to reach said predetermined maximum flow rate is in the range of about 25 to about 75% of the total filling time for said gas.

3. The method of claim 1, wherein step (c) is begun when the gas vessel contains about 75 to about 95% of the desired final quantity of said gas.

4. The method of any one of claims 1–3, wherein said initial rate is sufficiently low to avoid any sudden increase in the temperature of gas in said gas vessel.

5. The method of any one of claims 1–3, wherein the rate of increase of flow of said gas into said vessel is sufficiently low to avoid any sudden increase in the temperature of gas in said gas vessel.

6. The method of any one of claims 1–3, wherein said rate of increase of gas flow into said gas vessel during step (b) is constant.

7. The method of any one of claims 1–3, wherein the rate of flow of said gas into said vessel during step (b) increases as the difference between the predetermined maximum flow rate and the measured flow rate decreases.

8. The method of any one of claims 1–3, wherein the rate of decrease of flow of said gas into said gas vessel during step (c) is constant.

9. The method of any one of claims 1–3, wherein the rate of flow of said gas into said vessel during step (c) decreases as the difference between the actual quantity of said gas in said gas vessel and the desired final quantity of said gas in said gas vessel decreases.

10. The method of any one of claims 1–3, wherein said actual quantity of said gas in said gas vessel and said desired final quantity of said gas in said vessel are determined by the partial pressure of said gas contained in said gas vessel.

11. The method of any one of claims 1–3, wherein said gas vessel is a gas cylinder.

12. A process for filling a gas vessel with a mixture of two or more gases wherein at least one component of the mixture is charged into said gas vessel by the method of any one of claims 1–3.

13. The process of claim 12, wherein the components of said mixture are serially charged into said gas vessel by repeating steps (a) to (d) for each of said components.

14. The method of claim 1, wherein step (c) is begun when the gas vessel contains about 85 to about 95% of the desired final quantity of said gas.

15. The method of claim 1, wherein the rate of flow of said gas during steps (a) to (c) is determined by a preselected program.

* * * * *